US006827603B1

(12) United States Patent
Lin

(10) Patent No.: US 6,827,603 B1
(45) Date of Patent: Dec. 7, 2004

(54) DETACHABLE CONNECTOR FOR A LAMP ON A PENDENT LAMP

(76) Inventor: Shih-Ming Lin, No. 8, Lane 191, Hsihsin St., Chuangya Village, Hsiushiu Hsiang, Changhua Hsien (TW)

( * ) Notice: Subject to any disclaimer, the term of this patent is extended or adjusted under 35 U.S.C. 154(b) by 0 days.

(21) Appl. No.: 10/668,575

(22) Filed: Sep. 23, 2003

(51) Int. Cl.[7] ..... H01R 13/60
(52) U.S. Cl. ..... 439/542; 439/533; 362/406
(58) Field of Search ..... 439/542, 541, 439/543, 540.1, 576, 533, 529, 348; 362/405, 406, 226, 370

(56) References Cited

U.S. PATENT DOCUMENTS 6,371,632 B1 * 4/2002 Lavy ..... 362/406
6,422,722 B1 * 7/2002 Voltolina ..... 362/405
6,489,560 B1 * 12/2002 Wu ..... 174/65 R
6,517,223 B2 * 2/2003 Hsu ..... 362/405
6,565,240 B1 * 5/2003 Wu ..... 362/405
6,589,075 B1 * 7/2003 Wu ..... 439/550
6,612,531 B2 * 9/2003 Wu ..... 248/317
6,685,346 B2 * 2/2004 Wu ..... 362/405
6,692,140 B2 * 2/2004 Wu ..... 362/370
6,695,464 B1 * 2/2004 Wu ..... 362/410
2003/0012027 A1 * 1/2003 Hsu ..... 362/404
2003/0099109 A1 * 5/2003 Wu ..... 362/370
2003/0100222 A1 * 5/2003 Wu ..... 439/542
2003/0119356 A1 * 6/2003 Wu ..... 439/550
2003/0151923 A1 * 8/2003 Wu ..... 362/405
2003/0152423 A1 * 8/2003 Wu ..... 403/299
2004/0012972 A1 * 1/2004 Wu ..... 362/410
2004/0022062 A1 * 2/2004 Wu ..... 362/405
2004/0050574 A1 * 3/2004 Wu ..... 174/65 R
2004/0052074 A1 * 3/2004 Wu ..... 362/226

* cited by examiner

*Primary Examiner*—Ross Gushi
(74) *Attorney, Agent, or Firm*—William E. Pelton, Esq.

(57) ABSTRACT

An detachable connector for a lamp on a pendent lamp has a holder, a socket, an attaching device, a plug and a connecting tube. The holder is mounted in the frame of the pendent lamp. The socket is detachably attached to the holder by the attaching device and is electrically connected to a power source. The plug corresponds to and is selectively inserted into the socket to electrically connect to the socket and is electrically connected to the lamp. The connecting tube is securely attached to the plug and is connected to the lamp. Accordingly, the lamp is detachable from the frame of the pendent lamp so a person can easily and conveniently assemble the pendent lamp. In addition, the space for transporting or storing the pendent lamp can be reduced.

7 Claims, 8 Drawing Sheets

DETACHABLE CONNECTOR FOR A LAMP ON A PENDENT LAMP

BACKGROUND OF THE INVENTION

1. Field of the Invention

The present invention relates to a detachable connector, and more particularly to an detachable connector for a lamp on a pendent lamp to easily and quickly attach the lamp to or detach the lamp from the pendent lamp.

2. Description of Related Art

A pendent lamp is suspended from ceiling to provide illumination in addition to a decorative effect indoors.

With reference to FIG. 8, a conventional pendent lamp comprises a frame (40), a suspension member (46), multiple connecting arms (44) and a corresponding number of lamps (42). The suspension member (46) such as a chain, a post or the like has an upper end (not numbered) and a lower end (not numbered). The upper end is attached to a ceiling (not shown), and the frame (40) is attached to the lower end. The connecting arms (44) such as tubes respectively have inner ends (not numbered) and outer ends (not numbered). The inner ends are securely attached to and extend out from the frame (40). The lamps (42) are connected respectively to the outer ends of the connecting (44). Wires (not shown) are connected to the lamps (42), extend through the corresponding connecting arms (44), the frame (40) and the suspension member (46) and are electrically connected to a power source (not shown). Accordingly, the lamps (42) will light and provide illumination.

However, the wires connected to the lamps (42) are not detachable from the frame (40) and the lamps (42). Therefore, the connecting members (44) and the lamps (42) of the conventional pendent lamp are securely connected to and cannot be detached from the frame (40) and prevent a person of ordinary skill from disassembling the conventional pendent lamp at home. Since the conventional pendent lamp is large, transporting the conventional pendent lamp requires a large space and is troublesome.

To overcome the shortcomings, the present invention provides an detachable connector for a lamp of a pendent lamp to mitigate or obviate the aforementioned problems.

SUMMARY OF THE INVENTION

The main objective of the invention is to provide an detachable connector for a lamp on a pendent lamp to allow the lamp to be detachable from the frame of the pendent lamp so a person can conveniently and easily connect the lamps to or detach the lamps from the frame.

The detachable connector for a lamp on a pendent lamp has a holder, a socket, an attaching device, a plug and a connecting tube. The holder is mounted in the frame of the pendent lamp. The socket is detachably attached to the holder by the attaching device and electrically connects to a power source. The plug corresponds to and is selectively inserted into the socket to electrically connect to the socket and is electrically connected to the lamp. The connecting tube is attached securely to the plug and is connected to the lamp. With such a detachable connector, the lamp is detachable from the frame of the pendent lamp such that a person can easily and conveniently assemble or disassemble the pendent lamp. Furthermore, the space required to transport or store the disassembled pendent lamp is reduced.

Other objectives, advantages and novel features of the invention will become more apparent from the following detailed description when taken in conjunction with the accompanying drawings.

DETAILED DESCRIPTION OF PREFERRED EMBODIMENT

Figure 1:
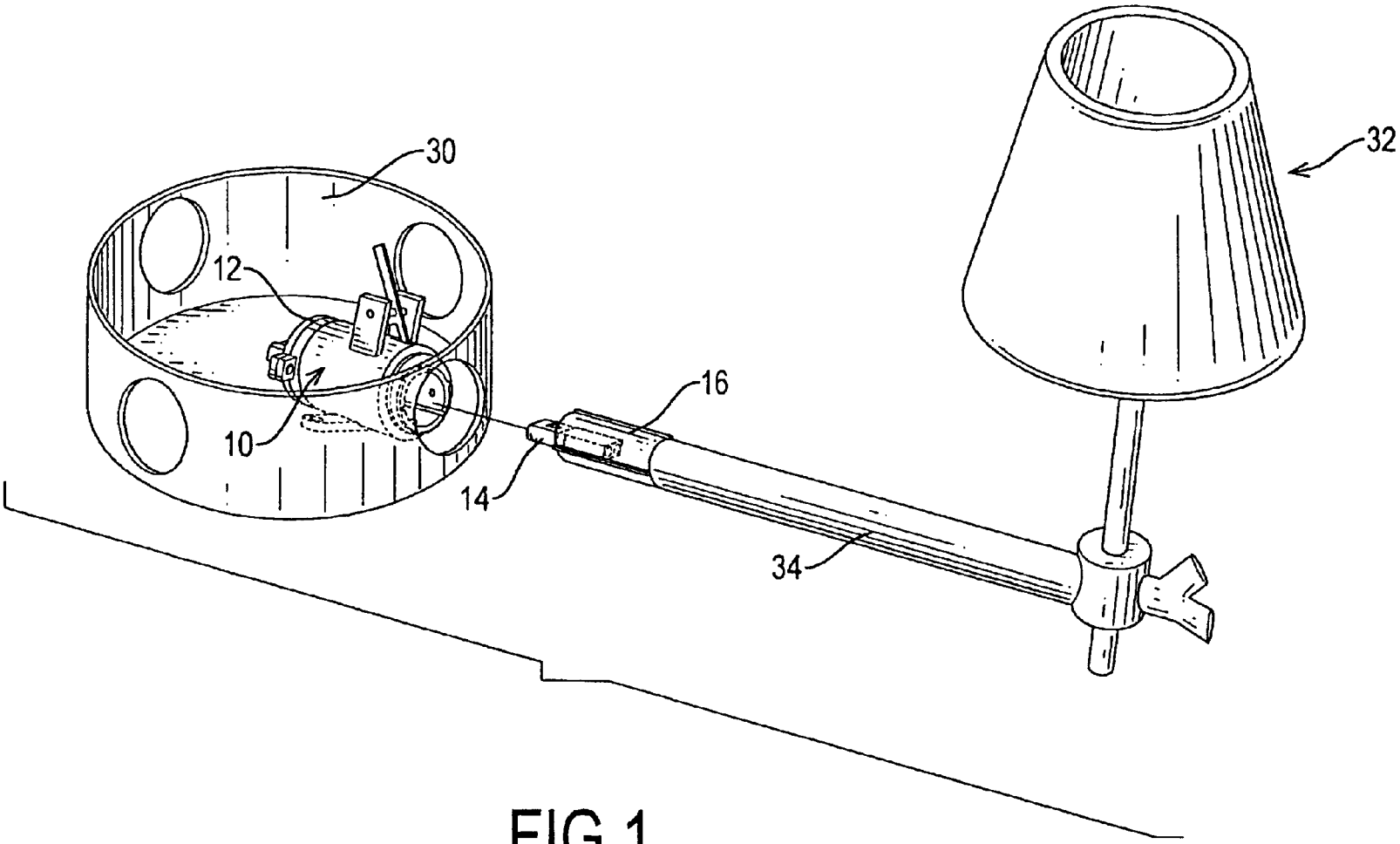
FIG. 1 is an exploded perspective view of a detachable connector in accordance with the present invention in a frame and a connecting member to a lamp of a pendent lamp.
Figure 2:
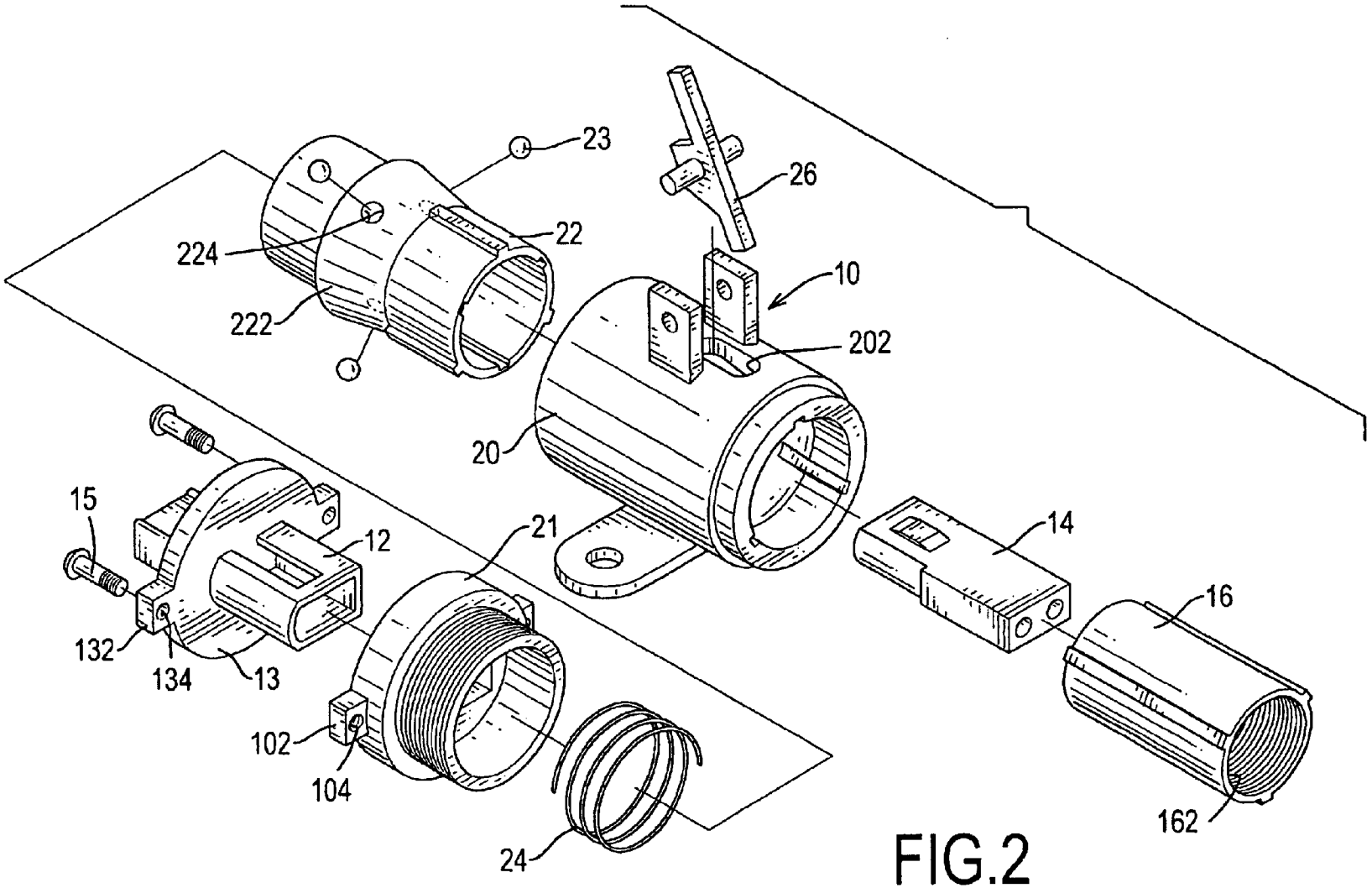
FIG. 2 is an exploded perspective view of a first embodiment of the detachable connector in FIG. 1.

With reference to FIGS. 1 and 2, a detachable connector in accordance with the present invention for a pendent lamp having a suspension member (not shown), a frame (30), multiple connecting members (34) and a corresponding number of lamps (32) selectively connects a connecting member (34) to the frame (30). The detachable connector comprises a holder (10), a socket (12), an attaching device (not numbered), a plug (14) and a connecting tube (16). The holder (10) is tubular, is mounted in the frame (30) of the pendent lamp and has a central chamber (not numbered), an inner open end (not numbered) and an outer open end (not numbered). In an optional embodiment, with further reference to FIG. 3, the holder comprises a body (20), a bottom cap (21), a sliding tube (22), multiple balls (23), a spring (24) and a pushing bar (26). The body (20) is tubular and has an outer surface (not numbered), an inner surface (not numbered), an inner open end (not numbered), an outer open end (not numbered), an elongated through hole (202) and a tapered surface (204). The elongated through hole (202) is longitudinally defined in the outer surface of the body (20), and the tapered surface (204) is formed on the inner surface of the body (20) and corresponds to the elongated through hole (202). The bottom cap (21) is attached to the inner open end of the body (20) to close the inner open end and has a hole (not numbered) defined through the bottom cap (21). The sliding tube (22) is moveably mounted in the body (20) through the outer open end and has an outer surface, a central passage (not numbered), a tapered surface (222) and multiple bores (224). The tapered surface (222) is formed on the outer surface of the sliding tube (22) and corresponds to the tapered surface (204) in the tubular body (20). The bores (224) are defined in the tapered surface (222) of the sliding tube (22), have a depth and communicate with the central passage. The balls (23) are moveably mounted respectively in the bores (224), and each ball (23) has a diameter larger than the depth of the corresponding bore (224). The spring (24) is mounted between the bottom cap (21) and the sliding tube (22) to push the tapered surface (222) on the sliding tube (22) against the tapered surface (204) in the body (20). Because each ball (23) has a diameter larger than the depth of the corresponding bore (224), the top of each ball (23) is pressed into the central passage. The pushing bar (26) is pivotally mounted on the body (20) and has a bottom penetrating through the elongated through hole (202) and corresponding to the sliding tube (22).

The socket (12) is detachably attached to the holder (10) at the inner open end with the attaching device and is electrically connected to a power source with a first set of wires (not shown). In the optional embodiment, the socket (12) is inserted into the hole in the bottom cap (21).

In a first embodiment, the attaching device comprises two first ears (102), a cap (13) and two bolts (15). The first ears (102) are formed on and extend from the holder (10), and each first ear (102) has a threaded hole (104). In the optional embodiment, the first ears (102) are formed on and extend from the bottom cap (21). The cap (13) is formed around the socket (12) and has two second ears (132) formed on the (13) cap and respectively corresponding to the first ears (102) on the holder (10). Each second ear (132) has a through hole (134) defined through the second ear (132) and aligning with the threaded hole (104) in the corresponding first ear (102). The bolts (15) penetrate respectively the through holes (134) in the second ears (132) and are screwed respectively into the threaded holes (104) in the first ears (102) on the holder (10) to attach the socket (12) to the holder (10).

The plug (14) corresponds to and is selectively inserted into the socket (12) from the outer open end in the holder (10) to electrically connect to the socket (12). The plug (14) is electrically connected to the lamp (32) of the pendent lamp with a second pair of wires (not shown). The connecting tube (16) has an outer surface (not numbered), an inner end (not numbered) and an outer end (not numbered), is attached securely to the plug (14) and is connected to the lamp (32) of the pendent lamp through a connecting member (34) such as a tube. A threaded hole (162) is defined in the outer end of the connecting tube (16), and the connecting member (34) has an exterior thread (not shown) screwed into the threaded hole (162) in the connecting tube (16). The second pair of wires extend through the connecting tube (16) and the connecting member (34) and are connected between the lamp (32) and the plug (14).

Figure 4:
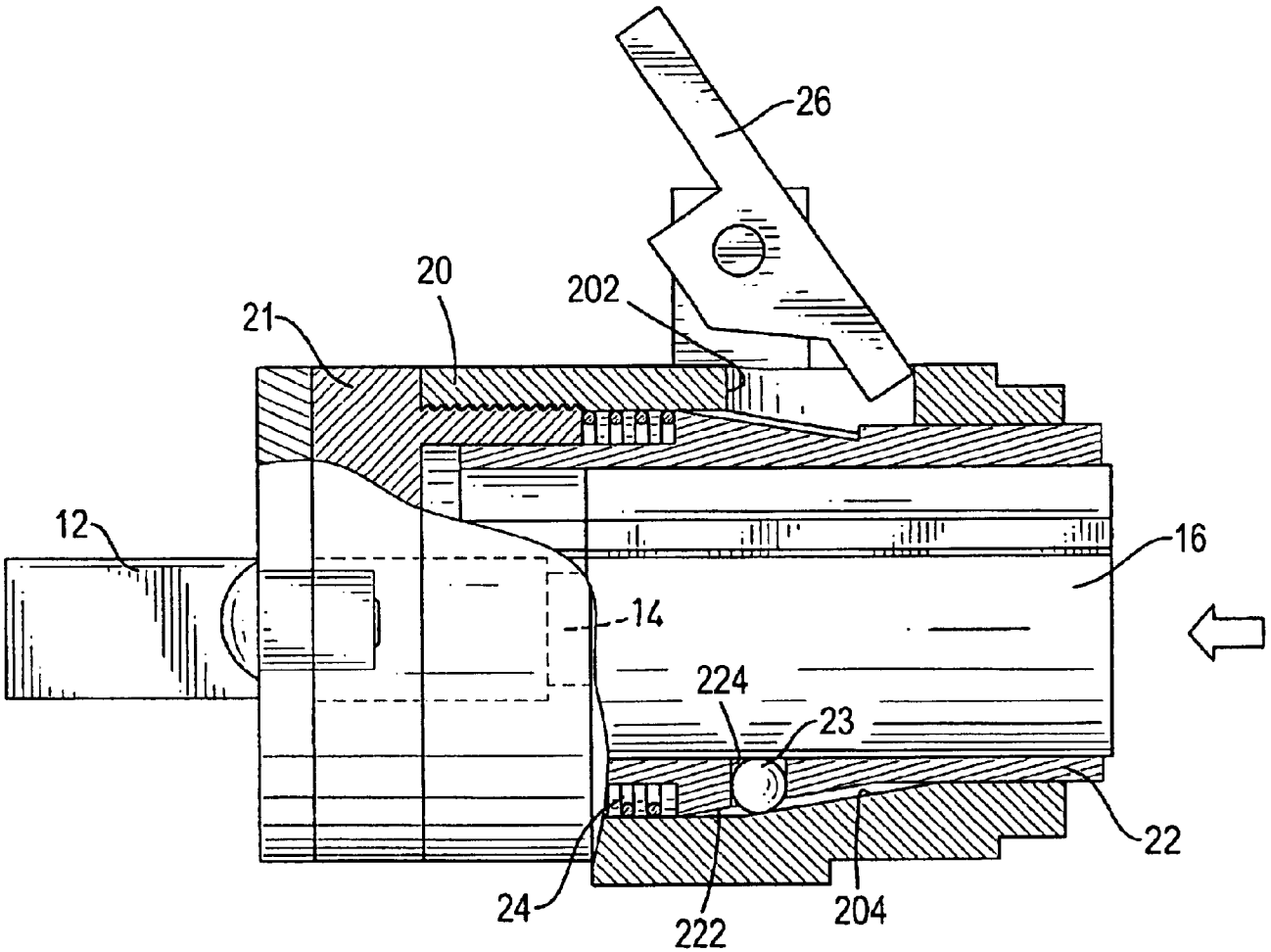
FIG. 4 is an operational side plan view in partial section of the adapter in FIG. 2.
Figure 5:
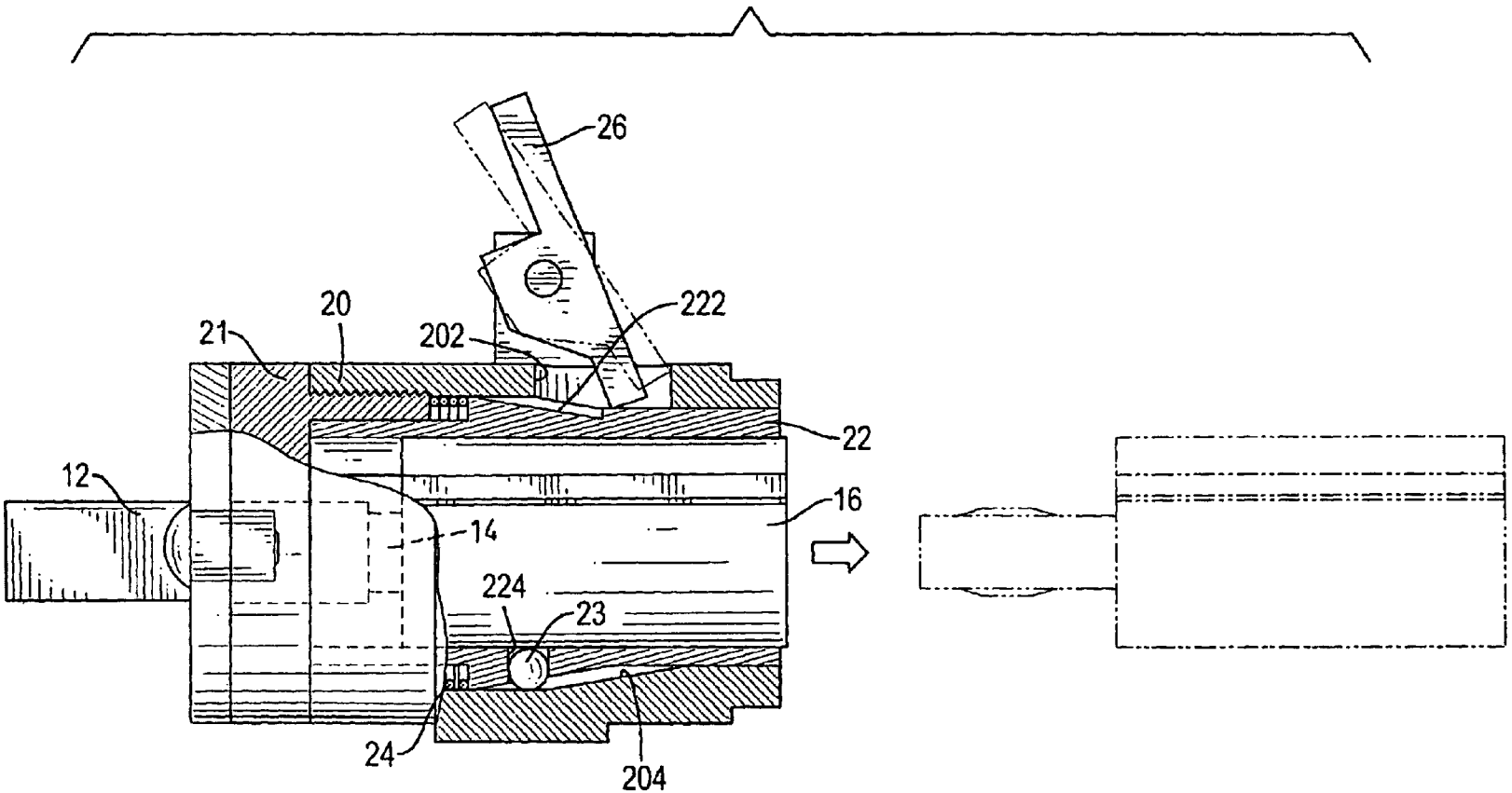
FIG. 5 is an operational side plan view in partial section of the adapter in FIG. 2.

With further reference to FIG. 4, the inner end of the connecting tube (20) abuts the tops of the balls (23) and pushes the sliding tube (22) to move relative to the tubular body (20) when the plug (14) is inserted into the socket (12). With the movement of the sliding tube (22) relative to the body (20), the tapered surface (222) on the sliding tube (22) separates from the tapered surface (204) in the body (20), and the balls (23) retract into the bores (224) to allow the connecting tube (22) to pass over the balls (23). Consequently, the plug (14) can be inserted into the socket (12), and the lamp (32) is selectively connected to a power source through the second pair of wires, the plug (14), the socket (12), the first pair of wires and a switch (not shown), and the lamp can be turned on to provide illumination. With a restitution force provide by the spring (24), the balls (23) are squeezed securely between the tapered surface (204) in the body (20) and the outer surface of the connecting tube (16). Accordingly, the connecting tube (16) is held securely in the holder (10) by the balls (23) and will not escape from the holder (10) even when the connecting tube (16) is pulled.

To release the connecting tube (16) with the plug (14) from the holder (10) with the socket (12), the pushing bar (26) is pivotally rotated and pushes the sliding tube (22) to move with the bottom of the pushing bar (26). With the movement of the sliding tube (22), the balls (23) will leave a position where the balls (23) abut against the outer surface of the connecting tube (16). Accordingly, the force for securely holding the connecting tube (16) provided by the balls (23) is released, the connecting tube (16) with the plug (14) can be detached from the holder (10). Because the plug (14) is detachably attached to the socket (12), the lamp (32) with the connecting tube (16) and the plug (14) can be detached from the socket (12). Therefore, the lamps (32) can be disassembled from the frame (30), and any person can conveniently and easily assemble the lamp (32) to the frame (30) by inserting the plug (14) into the socket (12). Accordingly, the lamps (32) with the connecting members (34) can be detached from the frame (30) when the pendent lamp is packaged, such that the space for transporting or storing the pendent lamp is reduced.

Figure 6:
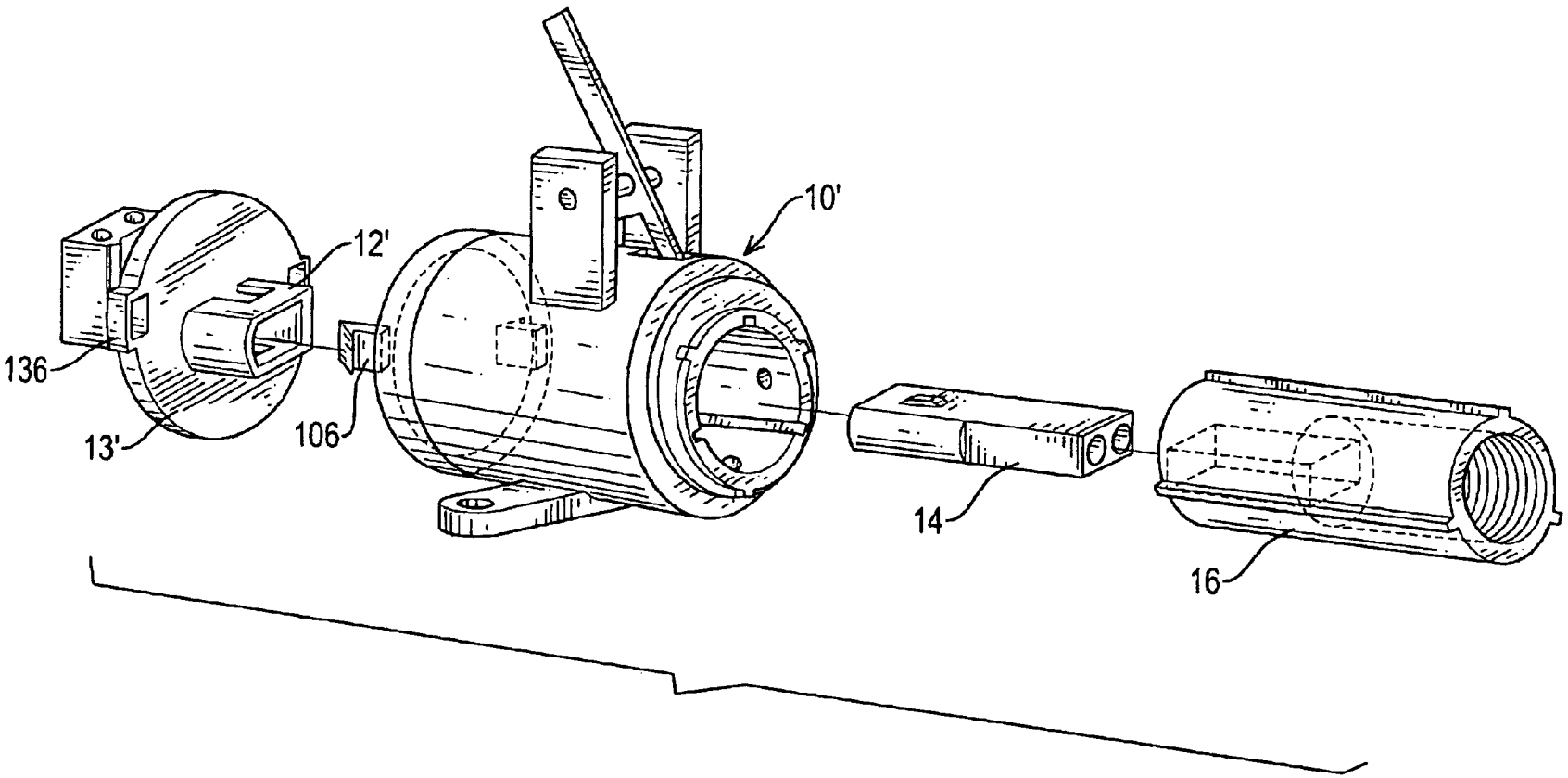
FIG. 6 is an exploded perspective view of a second embodiment of a detachable connector in accordance with the present invention for a lamp of a pendent lamp.

With reference to FIG. 6, a second embodiment of the attaching device comprises two hooks (106) and a cap (13'). The hooks (106) are formed on the holder (10). The cap (13') is formed around the socket (12') and has two through holes (136) formed on the cap (13') and respectively corresponding to the hooks (106) on the holder (10'). When the socket (12') is inserted into the open end of the holder (10'), the hooks (106) will book on the through holes (136) on the cap (13') to securely attach the socket (12') to the holder (10').

Figure 7:
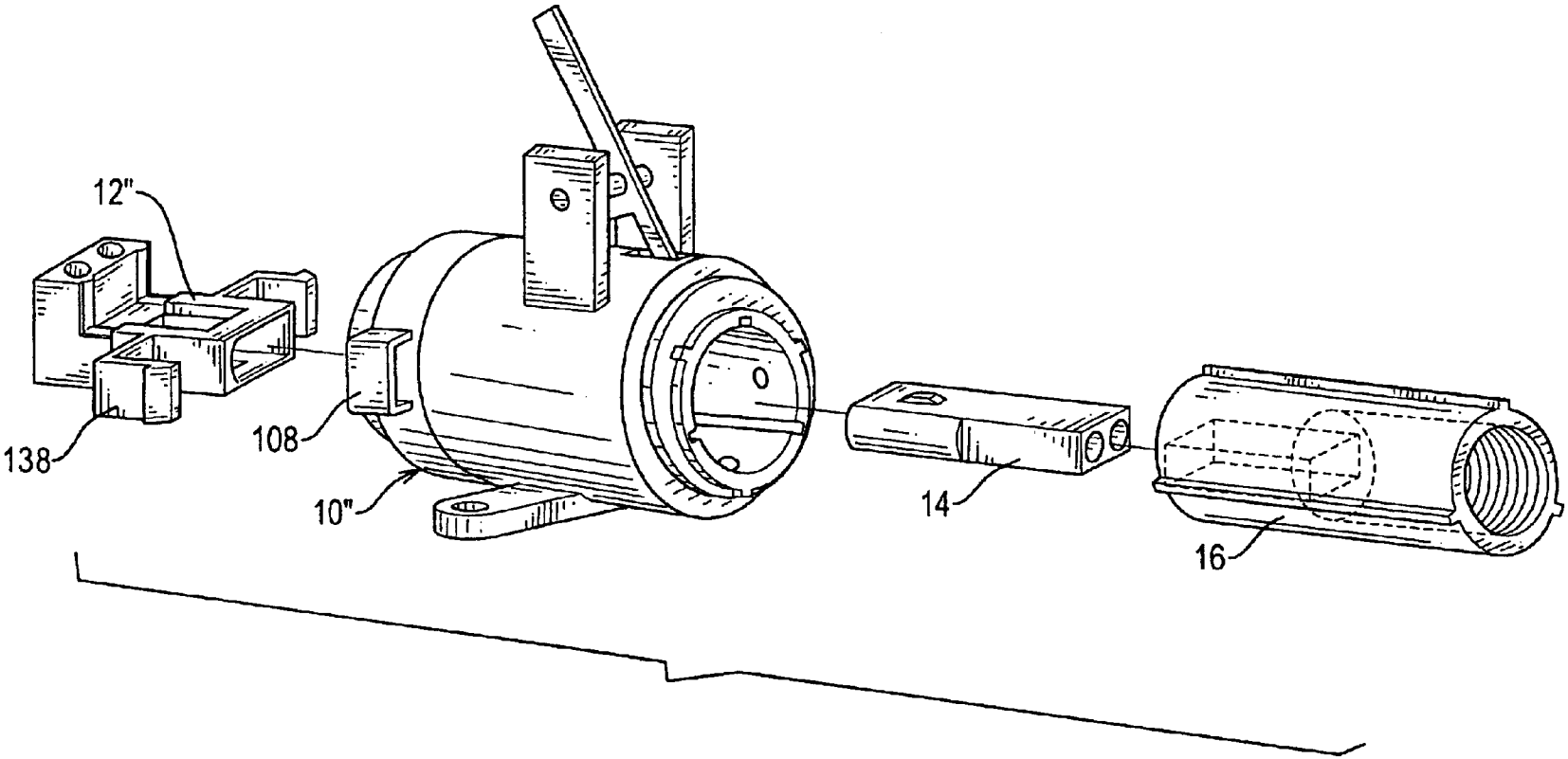
FIG. 7 is an exploded perspective view of a third embodiment of a detachable connector in accordance with the present invention for a lamp of a pendent lamp.
Figure 8:
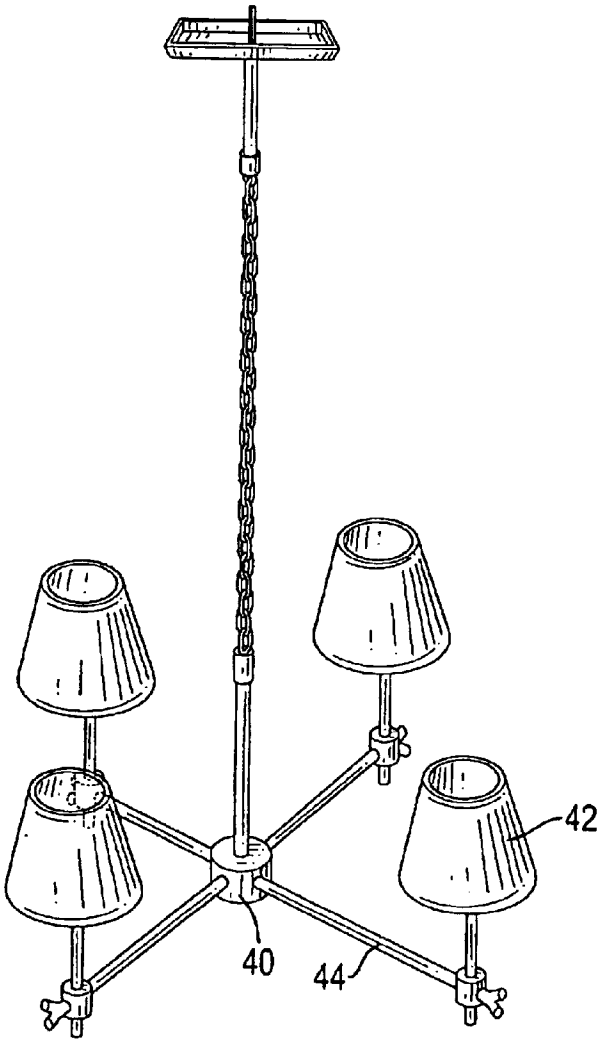
FIG.8 PRIOR ART
FIG. 8 is a perspective view of a conventional pendent lamp in accordance with the prior art.

With reference to FIG. 7, a third embodiment of the attaching device comprises two hooks (138) and two loops (108). The hooks (138) are integrally formed on the socket (12"), and the loops (138) are formed on the holder (10") and respectively correspond to the hooks (138) on the socket (12"). The socket (12") is securely attached to the holder (10") when the hooks (138) respectively engage the loops (108).

Figure 3:
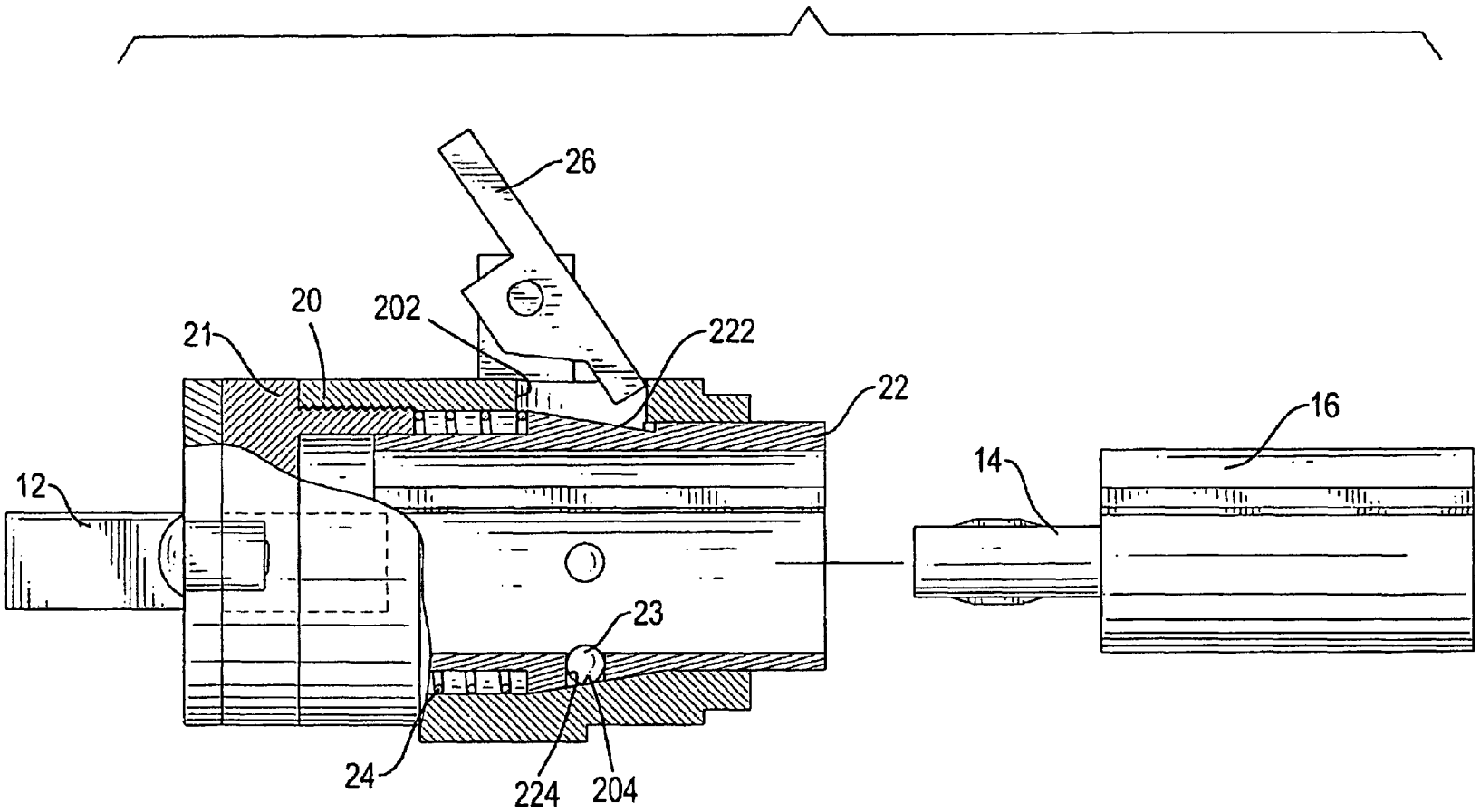
FIG. 3 is a side plan view in partial section of the adapter in FIG. 2.

With reference to FIGS. 3 and 4, the socket (12',12") in the second and third embodiment is L-shaped so the space in the frame (30) for mounting multiple adapters can be reduced.

Furthermore, the detaching device allows the socket (12, 12',12") to be detached from the holder (10,10',10") when the socket (12,12',12") or the holder (10,10',10") is damaged.

Even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. A detachable connector for a lamp on a pendent lamp comprising:

a holder having a central chamber with an inner open end and an outer open end;

a socket detachably attached to the inner open end to electrically connect to a power source;

an attaching device with elements formed on the socket and the holder that connect to each other to hold the socket on the inner end of the holder;

a plug corresponding to and selectively inserted into the socket to electrically connect to the socket and electrically connected to the lamp of the pendent lamp; and a connecting tube securely attached to the plug and connected to the lamp of the pendent lamp, wherein the holder comprises a tubular body having an outer surface and an inner surface, an elongated through hole longitudinally defined in the outer surface of the body and a tapered surface formed on the inner surface and corresponding to the elongated through hole;

a bottom cap attached to the inner open end of the body to close the inner open end;

a sliding tube moveably mounted in the body and extendable through the outer open end, said sliding tube having an outer surface, a central passage, a tapered surface formed on the outer surface and corresponding to the tapered surface in the tubular body, multiple bores being defined through the tapered surface of the sliding tube and communicating with the central passage, each respective bore having a depth;

multiple balls moveably mounted respectively in the bores, each ball having a diameter larger than the depth of its corresponding bore;

a spring mounted between the bottom cap and the sliding tube; and a pushing bar pivotally mounted on the body and having a bottom penetrating through the elongated through hole and corresponding to the sliding tube.

2. The detachable connector as claimed in claim 1, wherein the attaching device comprises:

two first ears formed on and extending from the holder, and each first ear having a threaded hole;

a cap formed around the socket and having two second ears formed on the cap and corresponding respectively to the first ears on the holder, and each second ear having a through hole defined through the second ear and aligning with the threaded hole in the corresponding first ear; and two bolts penetrating respectively through the through holes in the second ears and screwed respectively into the threaded holes in the first ears on the holder to attach the socket to the holder.

3. The detachable connector as claimed in claim 2, wherein the first ears are formed on and extend from the bottom cap.

4. The detachable connector as claimed in claim 1, wherein the attaching device comprises:

two hooks formed on the holder; and a cap formed around the socket and having two through holes formed on the cap and respectively corresponding to and hooked by the hooks on the holder.

5. The detachable connector as claimed in claim 4, wherein the socket is L-shaped.

6. The detachable connector as claimed in claim 1, wherein the attaching device comprises:

two hooks integrally formed on the socket; and two loops formed on the holder and respectively corresponding to and hooked by the hooks on the socket.

7. The detachable connector as claimed in claim 6, wherein the socket is L-shaped.

* * * * *